US006118059A

United States Patent [19]

Ternes

[11] Patent Number: 6,118,059

[45] Date of Patent: Sep. 12, 2000

[54] PINKY RETAINING DEVICE FOR A MUSICAL INSTRUMENT

[76] Inventor: Roger J. Ternes, 1250 Paseo de Marcia, Palm Springs, Calif. 92264

[21] Appl. No.: 09/265,768

[22] Filed: Mar. 10, 1999

[51] Int. Cl.[7] ..... G10D 7/10

[52] U.S. Cl. ..... 84/387 R; 84/453; 84/387 A

[58] Field of Search ..... 84/387 A, 387 R, 84/453; D17/10, 11, 13

[56] References Cited

U.S. PATENT DOCUMENTS

| | | | |
|---|---|---|---|
| D. 339,601 | 9/1993 | Diefes . | |
| 1,280,325 | 10/1918 | Stewart | 84/387 A |
| 2,847,892 | 8/1958 | Laas et al. . | |
| 2,918,838 | 12/1959 | Worrel | 84/465 |
| 3,141,369 | 7/1964 | Miccio . | |
| 3,847,051 | 11/1974 | Miller . | |
| 4,642,895 | 2/1987 | Gauvry . | |
| 5,553,529 | 9/1996 | Smith . | |

FOREIGN PATENT DOCUMENTS 117543 5/1999 Germany .

OTHER PUBLICATIONS

Vincent Bach Corporation, "Bach Instruments of Quality", pp. 11 and 15 (1961).

King, Catalog No. 21A, cover page and pages 8 and 9 (1964).

*Primary Examiner*—Robert E. Nappi
*Assistant Examiner*—Shih-yung Hsieh
*Attorney, Agent, or Firm*—David Weiss

[57] ABSTRACT

A pinky retaining device for a trumpet or other valved instrument, a preferred embodiment of which is laterally and vertically adjustable with respect to the valves and angularly oriented so as to accommodate the natural position and constrain the natural movements of the musician operator's pinky while playing the instrument.

17 Claims, 2 Drawing Sheets

Fig. 3.
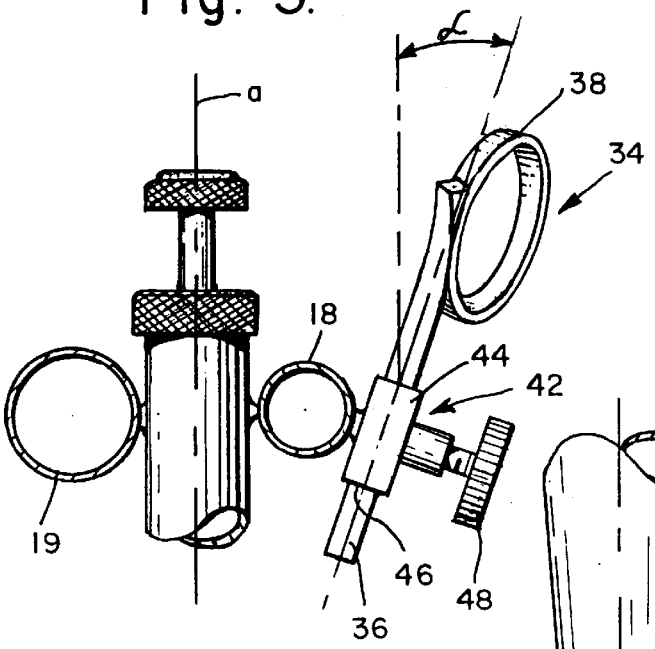
Fig. 4.
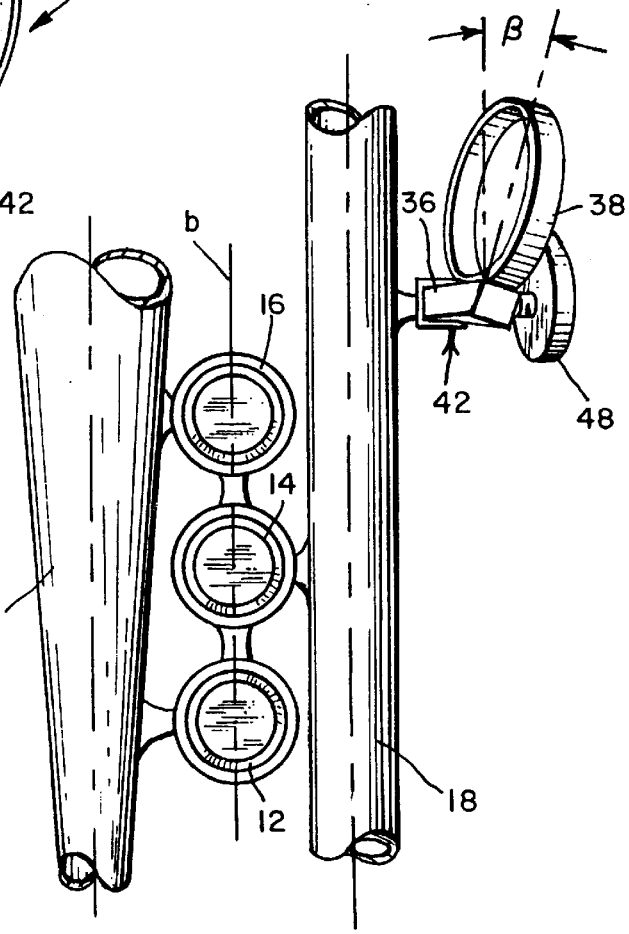
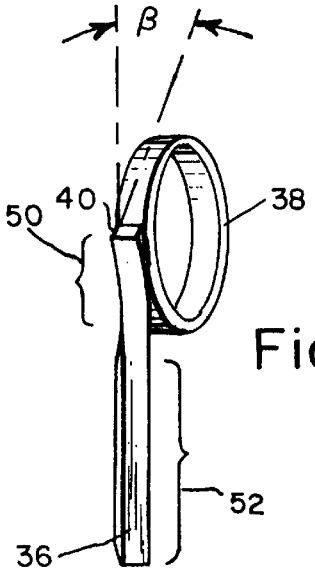
Fig. 5.
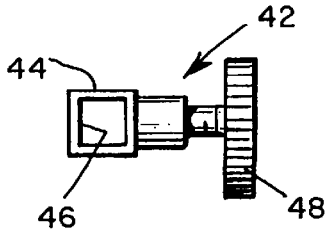
Fig. 6.

PINKY RETAINING DEVICE FOR A MUSICAL INSTRUMENT

BACKGROUND OF THE INVENTION

This invention relates to musical instruments, and more particularly to devices secured to a valved musical instrument such as a trumpet for retaining the little finger or pinky of the musician operator while the instrument is being played.

Valved musical instruments, such as a trumpet, typically include a finger hook or ring adjacent the valves for being engaged by the little finger or pinky of an operator musician. Such a device assists the operator in holding the instrument when played, while at the same time the device helps to secure the musician's pinky in such manner as to maintain it stationary with respect to the remaining fingers on the musician's hand. Because tendons between adjacent fingers, especially between the pinky and the third finger, tend to cause involuntary movement of other fingers upon voluntary movement of only one finger, an unconstrained pinky would result in the musician not having as much control of his three valve fingers as he would like.

With respect to a valved instrument such as a trumpet or cornet, the prior art includes a pinky ring or hook soldered or welded to the instrument's mouthpipe forwardly of the third valve. As used herein, the term "trumpet" is meant to include a trumpet as well as valved musical instruments resembling a trumpet such as a cornet. Although such prior art pinky retaining devices are effective aids for holding the trumpet and for maintaining the musician's pinky stationary relative to his valve fingers, many musicians have experienced finger discomfort, irritation and fatigue when using such devices. Efforts to mitigate such problems have taken the form of applying cushioning material to the pinky-engaging surface of such prior art finger rings and hooks, with generally inconsistent results.

SUMMARY OF THE INVENTION

By the present invention, a pinky retaining device is provided for a valved instrument, that more effectively prevents the finger discomfort, irritation and fatigue problems experienced by musician operators when using the pinky retaining devices of the prior art. The pinky retaining device of the present invention is laterally and vertically adjustable with respect to the valves and is preferably angularly oriented so as to accommodate the natural position and constrain the natural movements of the musician operator's pinky while playing the instrument.

Briefly described, the pinky retaining device of the present invention comprises, in combination with a musical instrument having a plurality of valves actuable along parallel respective axes by the fingers of an operator: an elongate member secured to the instrument and longitudinally disposed along an acute angle with respect to the valve axes laterally of the instrument, the elongate member preferably adjustable along such acute angle; and a curved member secured to the elongate member for accommodating the operator's pinky. The curved member is secured to the elongate member forwardly and laterally of the valves, and is preferably angularly disposed with respect to the valve alignment, laterally of the instrument.

When in combination with a trumpet conventionally including a mouthpipe and a plurality of valves arranged substantially parallel to the mouthpipe and actuable by the fingers of a musician operator along valve axes substantially perpendicular to the mouthpipe, a preferred embodiment of the pinky retaining device according to the present invention comprises: an elongate member secured to the mouthpipe and longitudinally disposed along an acute angle with respect to the valve axes laterally of the trumpet, the elongate member preferably being adjustable along such acute angle; and a curved member secured to the elongate member for accommodating the operator's pinky, the curved member preferably being angularly disposed with respect to the mouthpipe laterally of the trumpet. The curved member is secured to the elongate member forwardly and laterally of the valves. The preferred embodiment includes a holder secured to the mouthpipe and cooperating with the elongate member to adjustable secure the elongate member along such acute angle, and for this purpose the holder includes an elongate opening longitudinally extending through the holder along the acute angle and receiving the elongate member, and a securement member communicating with the opening to adjustably secure the elongate member to the holder along the opening.

BRIEF DESCRIPTION OF THE DRAWINGS

The novel features which are believed to be characteristic of the invention, together further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

FIG. 3 is a fragmentary cross-sectional elevation view of the trumpet of FIG. 2, taken along the line 3—3 in the direction of the appended arrows, showing the preferred embodiment of the pinky retainer device of the present invention in combination with a trumpet;

FIG. 4 is a fragmentary top plan view of the apparatus shown in FIG. 3;

FIG. 5 is a perspective view of the elongate member and attached curved member according to the preferred embodiment of the present invention; and FIG. 6 is a plan view of the holder device shown in FIGS. 3 and 4.

DETAILED DESCRIPTION OF THE PREFERRED EMBODIMENT

Figure 1:
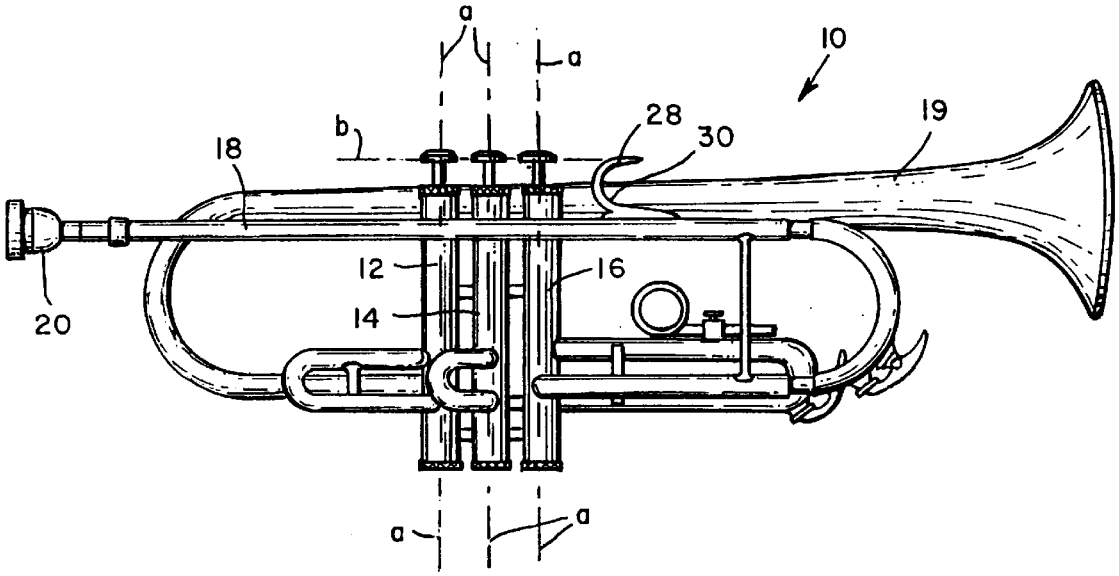
Fig. 1. (PRIOR ART)
FIG. 1 is a side elevation view of a trumpet including a prior art pinky retainer.

Turning first to FIG. 1, a conventional trumpet 10 includes three valves 12, 14, 16, situated between and secured to a mouthpipe 18 and a bellpipe 19, the valves 12, 14, 16 actuable by the fingers of a musician operator along axes a substantially perpendicular to the mouthpipe 18. When the trumpet 10 is held and played by a musician operator in the normal manner, the mouthpipe 18 extends forwardly of the operator's mouth (from mouthpiece 20), generally horizontally, with the valve axes a generally vertically oriented. The operator's fingers actuate the valves by contacting valve caps 22, 24, 26 and pressing them downwardly along the valve axes a (i.e., the operator's first or index finger contacts valve cap 22, his second finger contacts valve cap 24, and his third or ring finger contacts valve cap 26), and the valve caps 22, 24, 26—and hence the valves 12, 14, 16—are linearly arranged or aligned (e.g. along a line b) substantially parallel to the mouthpipe 18. The valves 12, 14, 16 are adjacent the mouthpipe 18, and the mouthpipe 18 is laterally of the valves 12, 14, 16. A pinky hook 28 is secured to the mouthpipe 18, typically by soldering or welding, in the vicinity of the valves and forwardly of the third valve 26, for accommodating and retaining the pinky or little finger of the musician operator while permitting the operator to utilize his other three fingers for actuating the valves 22, 24, 26. The pinky hook 28 includes a curved surface 30 for accommodating and retaining the operator's pinky. In some trumpets of the prior art, the hook 28 may be replaced by a ring, and in either case the hook 28 or ring is secured along the mouthpipe 18, generally parallel to the alignment b of the valves 12, 14, 16 and to the valve axes a.

Figure 2:
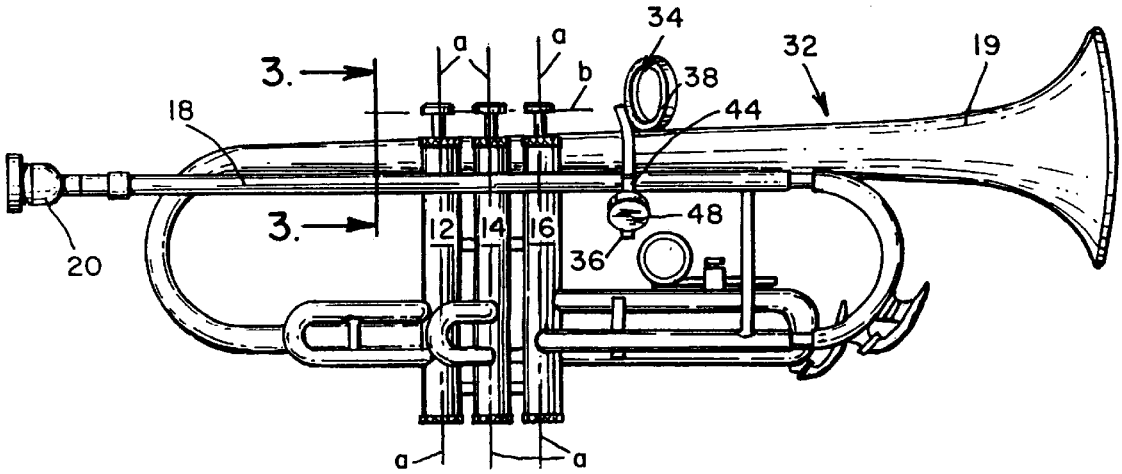
FIG. 2 is a side elevation view of a trumpet including a preferred embodiment of a pinky retainer device according to the present invention.

The trumpet 32 according to the present invention is shown in FIG. 2, wherein a preferred embodiment of the pinky retaining device 34 of the present invention is utilized in place of the pinky hook 28 (or pinky ring) shown in FIG. 1. Except for the pinky retaining device 34 of the present invention, the trumpet 32 as shown in FIG. 2 is generally similar to the trumpet 10 shown in FIG. 1, and the same reference numerals are utilized in FIG. 2 to identify components similar to those shown in FIG. 1.

Considering FIGS. 3, 4, 5 and 6 in conjunction with FIG. 2, the preferred embodiment of the pinky retaining device 34 of the present invention includes an elongate member 36 (preferably of metal such as brass or steel), preferably of rectangular or square cross-section. A ring 38 or other curved member (such as a hook) for accommodating the pinky of a musician operator is secured to the elongate member 36 in the vicinity of one end 40 thereof (the upper end as viewed in the drawing of FIG. 5). The curved member or ring 38 (preferably of metal such as brass or steel) may be secured to the elongate member 36 by soldering or welding. Alternatively, the elongate member 36 and the curved member 38 may be fabricated of a single length of metal or other rigid material, which may be considered as the secured-together elongate member 36 and curved member 38.

The elongate member 36 is secured to the trumpet 32, forwardly and laterally of the valves 12, 14, 16 by means of a holder 42 secured as by soldering or welding to the mouthpipe 18, or by a clamping device (not shown) secured to the holder 42 and clampable to the mouthpipe 18. As best shown in FIGS. 3, 4 and 6, the holder 42 includes a tubular section 44 having an elongate opening 46 of rectangular or square configuration for receiving the elongate member 36. A thumbscrew 48 carried by the holder 42 communicates with the opening 46 for adjustably securing the elongate member 36 to the holder 42 longitudinally along the opening 46.

As best shown in FIG. 3, the holder 42 is secured to the mouthpipe 18 such that the elongate opening 46 of the holder 44 longitudinally extends along an acute angle $\alpha$ with respect to the valve axes a, laterally of the trumpet 32, i.e. the acute angle $\alpha$ is referenced to a line parallel to the valve axes a, laterally along a vertical plane when the trumpet 34 is held in normal manner for being played. Accordingly, the elongate member 36 is adjustably secured to the mouthpipe 18 such that the elongate member 36 is longitudinally disposed along the acute angle $\alpha$. By manipulating the thumbscrew 48, the operator may adjust the longitudinal position of the elongate member 36 along the acute angle $\alpha$, thereby varying the vertical position of the pinky ring 38 and its lateral distance from the valves 12, 14, 16. An example of a suitable angle $\alpha$ has been found to be about 15°, although other angles $\alpha$ may be utilized for different individuals according to their personal preference, e.g. by varying the securement position of the holder's tubular section 44 along the circumference of the mouthpipe 18.

The orientation of the pinky ring 38 with respect to the valve alignment (i.e. the line b shown in FIGS. 2 and 4) may be set to suit the preference of the musician operator. In the preferred embodiment of the pinky retainer device 34, the elongate member 36 may include a twisted or torsionally displaced portion 50 in the vicinity of its upper end 40 (see FIG. 5), so that the ring 38 is askew or rotationally displaced by an acute angle $\beta$ with respect to the normally square or rectangular cross-sectional portion 52 of the elongate member 36. When the elongate member 36 is received by the conforming opening 46 of the holder 42, the ring 38 is skewed or angularly disposed with respect to the mouthpipe 18 (as well as with respect to the valve alignment b) by the angle $\beta$, laterally of the trumpet, i.e. the angle $\beta$ is referenced to a line parallel to the mouthpipe 18 or valve alignment b, laterally along a horizontal plane when the trumpet 34 is held in normal manner for being played. In one example, a suitable angle $\beta$ has been found to be about 15°, although other angles B may be more appropriate for different individuals according to their personal preference, e.g. by varying the torsional displacement of elongate member 36 in the vicinity of its upper end 4.

Thus, there has been described a preferred embodiment of a device for use with a trumpet for retaining the pinky of the musician operator in an effective and comfortable manner while the trumpet is being played. Other embodiments of the present invention, and variations of the embodiment described herein, may be developed without departing from the essential characteristics thereof. Further, the present invention is applicable to valved instruments other than a trumpet; for example, embodiments of the present invention may be applied to a French horn or tuba. Accordingly, the invention should be limited only by the scope of the claims listed below.

I claim:

1. In combination with a musical instrument having a plurality of valves actuable along parallel respective axes by fingers of an operator, a device for retaining the operator's pinky comprising:

an elongate member secured to the instrument forwardly and laterally of the valves, said elongate member longitudinally disposed along an acute angle with respect to the valve axes, said acute angle being laterally of the instrument; and a curved member secured to said elongate member for accommodating the operator's pinky.

2. The device according to claim 1, wherein said curved member is secured to said elongate member forwardly and laterally of the valves.

3. The device according to claim 1, wherein the plurality of valves are in alignment and said curved member is angularly disposed with respect to the valve alignment and laterally of the instrument.

4. The device according to claim 1, wherein the securement of said elongate member to the instrument is adjustable along said acute angle.

5. The device according to claim 1, the plurality of valves being in alignment, wherein:

the securement of said elongate member to the instrument is adjustable along said acute angle; and said curved member is angularly disposed with respect to the valve alignment and laterally of the instrument.

6. The device according to claim 5, further including:

a holder secured to the instrument and cooperating with said elongate member to adjustably secure said elongate member along said acute angle.

7. The device according to claim 6, wherein said holder includes:

an elongate opening longitudinally extending through said holder along said acute angle and receiving said elongate member; and a securement member communicating with said opening for adjustably securing said elongate member to said holder.

8. In combination with a trumpet having a mouthpipe and a plurality of valves arranged substantially parallel to the mouthpipe and actuable by fingers of an operator along valve axes substantially perpendicular to the mouthpipe, a device for retaining the operator's pinky comprising:

an elongate member secured to the mouthpipe and longitudinally disposed along an acute angle with respect to the valve axes, said acute angle being laterally of the trumpet; and a curved member secured to said elongate member forwardly and laterally of the valves for accommodating the operator's pinky.

9. The device according to claim 8, wherein said curved member is angularly disposed with respect to the mouthpipe and laterally of the trumpet.

10. The device according to claim 8, wherein the securement of said elongate member to the mouthpipe is adjustable along said acute angle.

11. The device according to claim 8, wherein:

the securement of said elongate member to the mouthpipe is adjustable along said acute angle; and said curved member is angularly disposed with respect to the mouthpipe and laterally of the trumpet.

12. The device according to claim 11, further including;

a holder secured to the mouthpipe and cooperating with said elongate member to adjustably secure said elongate member along said acute angle.

13. The device according to claim 12, wherein said holder includes:

an elongate opening longitudinally extending through said holder along said acute angle and receiving said elongate member; and a securement member communicating with said opening to adjustably secure said elongate member to said holder along said opening.

14. For combination with a trumpet having a mouthpipe and a plurality of valves arranged substantially parallel to the mouthpipe and actuable by fingers of an operator along valve axes substantially perpendicular to the mouthpipe, a device for retaining the operator's pinky comprising:

an elongate member;

a holder having an elongate opening longitudinally extending through said holder, said holder adapted for being secured to the mouthpipe such that said elongate opening longitudinally extends along an acute angle with respect to the valve axes, said acute angle being laterally of the trumpet, said holder including a securement member communicating with said opening to adjustably secure said elongate member to said holder along said opening; and a curved member secured to said elongate member forwardly and laterally of the valves for accommodating the operator's pinky when said holder is secured to the mouthpipe.

15. The device according to claim 14, wherein said curved member is angularly disposed with respect to the mouthpipe and laterally of the trumpet when said elongate member is secured to said holder.

16. For combination with a trumpet having a mouthpipe and a plurality of valves arranged substantially parallel to the mouthpipe and actuable by fingers of an operator along valve axes substantially perpendicular to the mouthpipe, a device for retaining the operator's pinky comprising:

an elongate member;

a curved member for accommodating the operator's pinky, said curved member being secured to said elongate member; and a holder having an elongate opening longitudinally extending through said holder, said elongate member received by said opening, said holder adapted for being secured to the mouthpipe with said elongate member being forwardly and laterally of the valves, said holder including a securement member communicating with said opening to adjustably secure said elongate member to said holder along said opening.

17. The device according to claim 16, wherein said curved member is angularly displaced with respect to the mouthpipe laterally of the trumpet when said elongate member is secured to said holder.

* * * * *